US005376916A

United States Patent [19]

Ito

[11] Patent Number: 5,376,916

[45] Date of Patent: Dec. 27, 1994

[54] BUZZER DAMPING SOUND PRODUCING DEVICE

[75] Inventor: Yasuhiko Ito, Shizuoka, Japan

[73] Assignee: Yazaki Corporation, Tokyo, Japan

[21] Appl. No.: 31,332

[22] Filed: Mar. 15, 1993

[30] Foreign Application Priority Data

Mar. 13, 1992 [JP] Japan ..... 4-12707

[51] Int. Cl.[5] ..... G08B 3/00

[52] U.S. Cl. ..... 340/384.7; 340/384.1; 340/384.6

[58] Field of Search ..... 340/384 E, 384 R, 384.1, 340/384.7, 384.6

[56] References Cited

U.S. PATENT DOCUMENTS 4,482,888 11/1984 Todaka et al. ..... 340/384 E
4,602,551 7/1986 Firmani et al. ..... 340/384 E

FOREIGN PATENT DOCUMENTS 63-21698 1/1963 Japan .
2-28157 6/1990 Japan .

*Primary Examiner*—John K. Peng
*Assistant Examiner*—Daryl C. Pope
*Attorney, Agent, or Firm*—Sughrue, Mion, Zinn, Macpeak & Seas

[57] ABSTRACT

A buzzer damping sound producing device in which a fundamental frequency pulse signal is applied to a buzzer to produce a damping sound with a predetermined period. The device includes a variable duty pulse generator which produces a fundamental frequency pulse signal repeatedly, the duty ratio of which is gradually decreased per predetermined period. The fundamental frequency pulse signal thus produced is applied to the buzzer to operate the buzzer, whereby buzzer damping sounds different in period and frequency can be produced readily.

3 Claims, 6 Drawing Sheets

BUZZER DAMPING SOUND PRODUCING DEVICE

BACKGROUND OF THE INVENTION

1. Field of the Invention

This invention relates to a buzzer damping sound producing device, and more particularly to a buzzer damping sound producing device in which a fundamental frequency pulse signal is applied to a buzzer to repeatedly produce a damping sound with a predetermined period.

2. Background

A conventional buzzer damping sound producing device of this type is shown in FIG. 8.

In FIG. 8, reference numeral 1 designates a control circuit comprising a micro-computer (CPU) which operates according to a predetermined program. The control circuit 1 has a terminal $OP_1$ through which a pulse signal having a period T (having a first waveform) is outputted, and a terminal $OP_2$ through which a pulse signal of a fundamental frequency (having a second waveform) is outputted.

Reference numeral 2 designates a two-stage amplifier circuit including amplifying transistors $Q_1$ and $Q_2$. A capacitor 3, receiving the first waveform amplified by the amplifier circuit 2, is repeatedly charged and discharged to thereby form a damping voltage signal (having a third waveform). The second waveform is amplified by a one-stage amplifier circuit including an amplifying transistor $Q_3$. An output circuit 5 includes a transistor $Q_4$ which receives the second and third waveforms and outputs to a buzzer 6 a buzzer operating damping signal (having a fourth waveform), which is modified with the second and third waveforms 6. In the conventional circuit, the buzzer is typically driven with a signal of 5 volts.

In more detail, the pulse signal having the first waveform is provided at the output terminal $OP_1$ of the control circuit 1. This pulse signal is applied to the capacitor 3, so that the capacitor is repeatedly charged and discharged with the period T, thus outputting the signal having the third waveform. The signal thus outputted is applied to the output circuit 5, to which the pulse signal of the fundamental frequency (having the second waveform) is applied through the terminal $OP_2$ of the control circuit 1. As a result, the pulse signal of the fundamental frequency (the second waveform) is modulated with the above-described signal having the third waveform, so that the signal having the fourth waveform is formed. The signal thus formed is applied to the buzzer 6, so that a buzzer damping sound waveform, as shown in FIG. 9 is obtained.

In the conventional buzzer damping sound producing device thus designed, it is essential to use two kinds of pulse signals having different periods, and it is also necessary to perform an analog signal conversion by charging and discharging the capacitor 3. Hence, the conventional device is disadvantageous in that it is intricate in construction and requires a large number of components. Accordingly, it is difficult to reduce the size and weight of the modules thereof. Furthermore, the devices does not function adequately because the damping sound produced thereby is fundamentally of the same period.

SUMMARY OF THE INVENTION

Accordingly, an object of this invention is to eliminate the above-described difficulties accompanying a conventional buzzer damping sound producing device.

More specifically, an object of the invention is to provide a buzzer damping sound producing device which uses only one pulse signal to produce buzzer damping, and is able to produce buzzer damping sounds which are different in period and in frequency.

The foregoing object of the invention has been achieved by the provision of a buzzer damping sound producing device in which a fundamental frequency pulse signal is applied to a buzzer to produce a damping sound repeatedly with a predetermined period. The device comprises a variable duty pulse generating means for producing a fundamental frequency pulse signal, the duty ratio of which is gradually decreased per predetermined period and means for applying the fundamental frequency pulse signal to the buzzer.

In the device of the invention, the variable duty pulse generating means produces the fundamental frequency pulse signal the duty ratio of which is gradually decreased by a predetermined period, and the fundamental frequency pulse signal thus produced operates the buzzer. Hence, buzzer damping sounds different in period and in frequency can be readily obtained by changing the predetermined period and the fundamental frequency.

The nature, principle, and utility of the invention will be more clearly understood from the following detailed description of the invention when read in conjunction with the accompanying drawings.

DETAILED DESCRIPTION OF THE PREFERRED EMBODIMENTS

Figure 1:
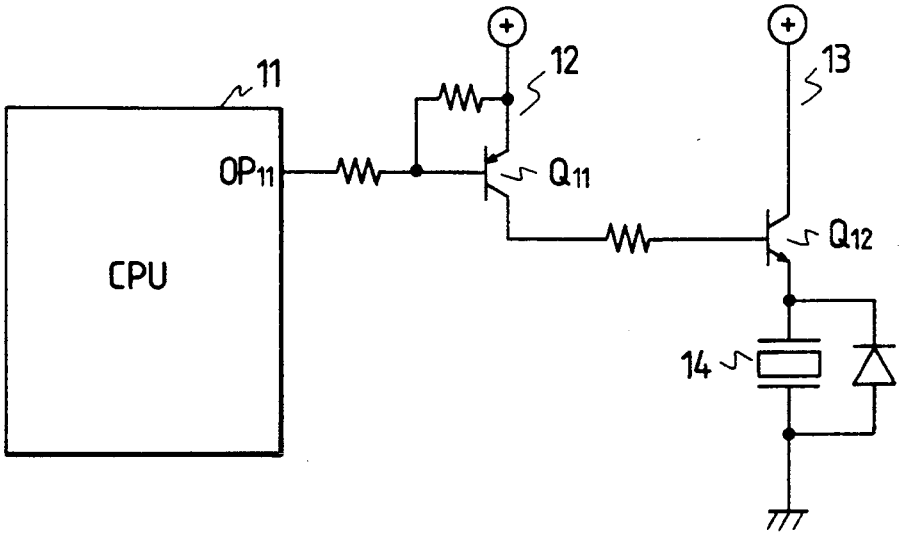
FIG. 1 is a circuit diagram, partly as a block diagram, showing the arrangement of a buzzer damping sound producing device, which constitutes one embodiment of this invention.

A buzzer damping sound producing device, which constitutes one embodiment of this invention, is shown in FIG. 1.

Figure 2:
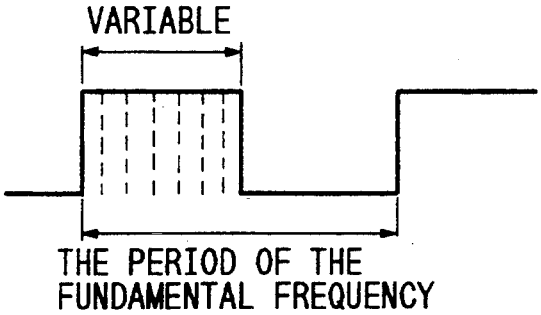
FIG. 2 is a diagram showing a buzzer operating output waveform which is produced by a control circuit shown in FIG. 1.

Referring to FIG. 1, the device includes a control circuit 11 including a micro-computer (CPU) which operates according to a predetermined control program. The control circuit 11 has an output terminal $OP_{11}$ through which a buzzer operating output waveform is outputted. The buzzer operating output waveform, as shown in FIG. 2, has a constant period and a frequency corresponding to a fundamental frequency, and its duty ratio is gradually decreased from about 50% to 0% per period T of a buzzer damping sound. The device further includes an amplifier circuit 12 including an amplifying transistor $Q_{11}$ for transmitting the buzzer operating output waveform, and an output circuit 14 including an output transistor $Q_{12}$ for applying the buzzer operating output waveform to a buzzer 14.

In the buzzer damping sound producing device thus designed, the buzzer operating output waveform is provided at the terminal $OP_{11}$ of the control circuit 11 and amplified by the amplifier circuit 12. The buzzer operating output waveform thus amplified is applied through the output circuit 13 to the buzzer 14, so as to operate the buzzer 14.

Figure 3:
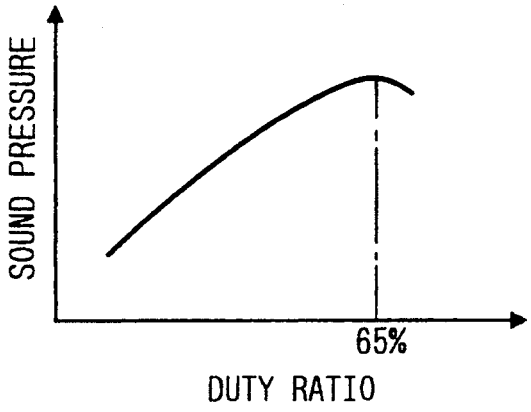
FIG. 3 is a graphical representation indicating buzzer sound pressures with duty ratios.

In general, the relationship between the duty ratio of a waveform applied to a buzzer and sound pressure is as indicated in FIG. 3. That is, the sound pressure is maximum when the duty ratio is about 65%, and the sound pressure decreases as the duty ratio decreases. However, as described above, according to the invention, the duty ratio of the buzzer operating output waveform is gradually decreased from about 50% to 0% during the period T, with the fluctuation characteristics of the buzzer taken into consideration, so that buzzer damping sound having the period T is produced.

An operation of the control circuit 11 to produce the buzzer operating output waveform will be described with reference to flow charts of FIGS. 4 and 5, which indicate the operations which the CPU in the control circuit 11 performs according to the control program.

Figure 4:
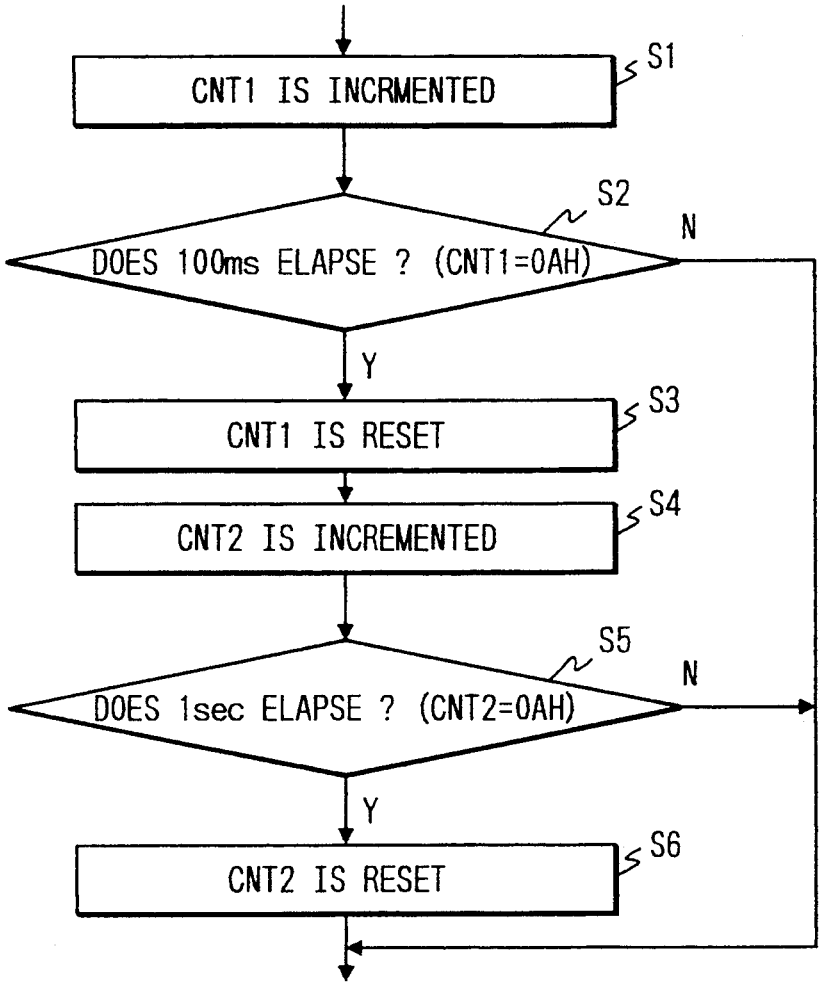
FIG. 4 is a flow chart showing a main routine executed by the control circuit in FIG. 1.
Figure 5:
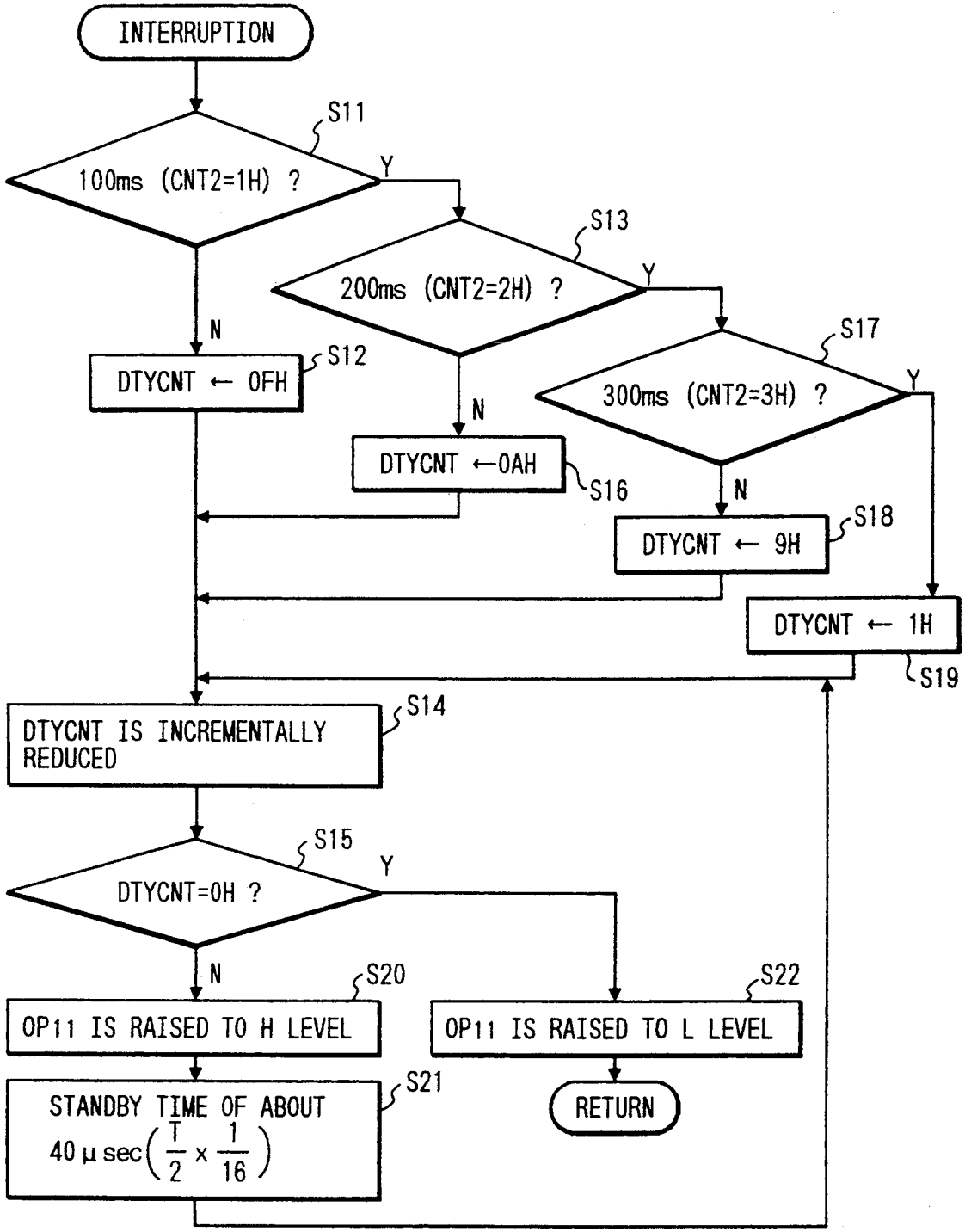
FIG. 5 is a flow chart showing an interrupt routine executed by the control circuit in FIG. 1.

FIGS. 4 and 5 respectively illustrate a main routine and an interrupt routine. In this connection, it is assumed that one cycle of the main routine is 10 ms (milliseconds), and the period of a buzzer damping sound to be produced is one second, and that an interrupt period is 1/(fundamental frequency); for instance, it is 1.25 ms when the fundamental frequency is 800 Hz, and the duty ratio is changed in sixteen (16) steps from 50% to 0%.

In the main routine of FIG. 4, in Step S1 a CNT1 (a hundred millisecond counter) is incremented in 10 ms intervals, and Step S2 is effected. In Step S2, it is determined whether or not the content of the CNT1 has reached a value (OAH) corresponding to 100 ms. When the result of determination is "No", after other steps in the main routine are executed, Step S1 is effected again. When the result of determination in Step S2 is "Yes", then Step S3 is effected. In Step S3, the CNT 1 is reset, and thereafter Step S4 is effected. In Step S4, a CNT 2 (a one-second counter) is incremented in 100 ms intervals.

Thereafter, Step S5 is effected to determine whether or not the content of the CNT2 has reached a value (OAH) corresponding to one second. When the result of determination is "No", other steps in the main routine are executed, and thereafter Step S1 is effected again. When the result of determination is "Yes", Step S6 is effected. In step S6, the CNT 2 is reset, and after other steps have been carried out, Step S1 is effected again.

During the above-described execution of the main routine, the interrupt routine shown in FIG. 5 is executed with a fundamental frequency of, for instance, 800 Hz (the period being 1.25 ms).

In Step S11 of the interrupt routine, it is determined from the content of CNT 2 whether or not 100 ms have passed. When the result of this determination is "No", Step S12 is effected; whereas when it is "Yes", Step S13 is effected.

In Step S12, a value OFH is set in a DTYCNT (a duty adjusting counter), and then Step S14 is effected. In the interrupt routine, the duty ratio is changed in sixteen (16) steps; however, the invention is not limited thereto or thereby. That is, the number of steps can be changed as desired. The greater the number of steps, the smoother the damping; in other words, the smoothness of the damping is proportional to the number of steps. The set value of the counter determines a sound pressure damping constant. In Step S14, the DTYCNY is incrementally reduced, and then Step S14 is effected.

When the determination in Step S11 is "Yes", Step S13 is effected to determine from the content of the CNT 2 whether or not 200 ms have passed. When the result of this determination is "No", Step S16 is effected; whereas when it is "Yes", Step S17 is effected. In Step S16, the value OAH is set in the DTYCNT, and thereafter Step S14 is effected.

In Step S17, it is determined whether or not 300 ms have passed. When it is determined that 300 ms have not passed, that is, the result of determination is "No", Step S18 is effected. When it is "Yes", a determination of time lapse is repeatedly carried out in the above-described manner with an increment of 100 ms each determination, and Step S19 is effected. In Step S18, a value 9H is set in the DTYCNT, and Step S14 is effected. In Step S19, a value 1H is set in the DTYCNT, and Step S14 is effected.

In Step S15, it is determined whether the content of the DTYCNT is OH. When the result of determination is "No", Step S20 is effected to raise the terminal $OP_{11}$ to "H" (high) level, and thereafter Step S21 is effected. In Step S21, there is a standby time of about 40 microseconds ($T/2\times1/16$), and thereafter Step S14 is effected again. This process continues until the result of determination in Step S15 is "Yes", at which point Step S22 is effected. In Step S22, the terminal $OP_{11}$ is set to "L" (low) level, and the operation is returned to the original main flow chart. The standby time in Step S21 is determined from the (optional) number of steps in which the duty ratio is changed, and the fundamental frequency of occurrence of the interrupt routine.

Figure 6:
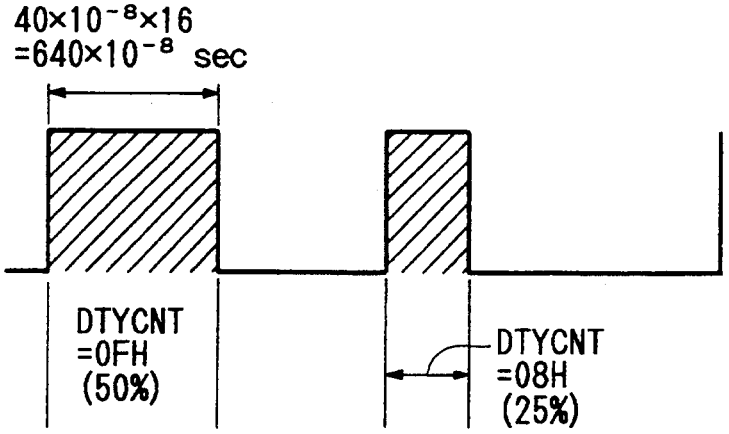
FIG. 6 is a waveform diagram showing one example of a buzzer operating output waveform which is formed when the device is operated as provided in the flow charts of FIGS. 4 and 5.
Figure 9:
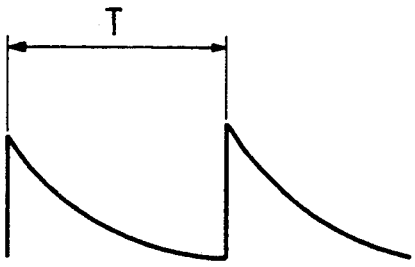
FIG. 9 is a waveform diagram showing a buzzer damping sound which is produced by the conventional device shown in FIG. 8.

Upon the above-described execution according to the flow charts, the control circuit 11 produces an output waveform as shown in FIG. 6; that is, it serves as variable duty pulse generator which repeatedly produces a fundamental frequency pulse signal, the duty ratio of which is gradually decreased from 50% to 0% per predetermined period. In FIG. 6, the shadowed portions (in which the terminal $OP_{11}$ is at the "H" level) are the time widths in which the interrupt routine is effected.

Figure 7A:
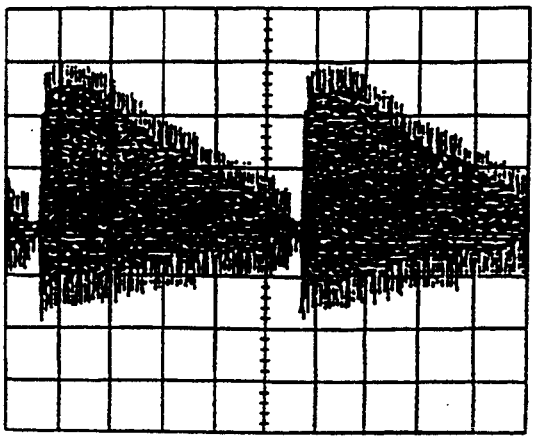
FIGS. 7(*a*), 7(*b*) and 7(*c*) are diagrams showing outputs of the device which are measured with a sound pressure meter.
Figure 7B:
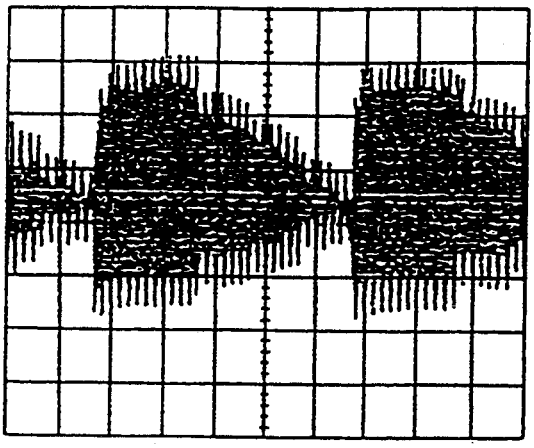
Figure 7C:
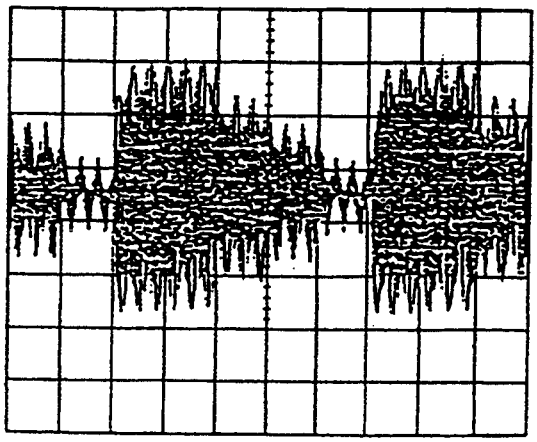
Figure 8:
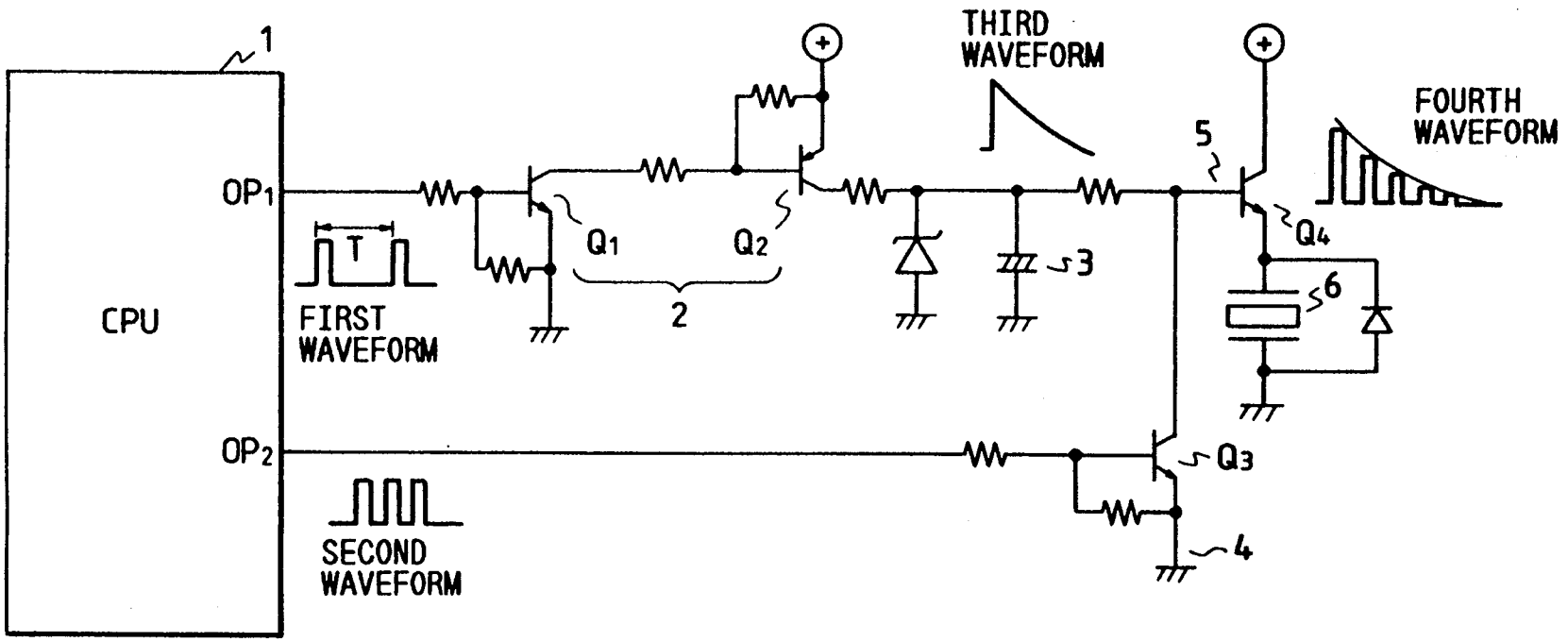
FIG. 8 PRIOR ART
FIG. 8 is a circuit diagram, partly as a block diagram, showing the arrangement of a conventional buzzer damping sound producing device.

When the buzzer was operated with a variety of output waveforms formed in the above-described manner, it produces buzzer damping sounds which, when measured with a sound pressure meter, were as shown in the FIGS. 7(*a*)–7(*c*) for instance.

As was described above, in the device of the invention, the variable duty pulse generator produces the fundamental frequency pulse signal repeatedly, the duty ratio of which is gradually changed per certain period, to operate the buzzer. Hence, buzzer damping sounds different in period and in frequency can be readily produced by changing the fundamental frequency and the period.

While the invention has been described in connection with the preferred embodiment thereof, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A buzzer damping sound producing device in which a fundamental frequency pulse signal is applied to a buzzer to produce a damping sound repeatedly with a predetermined period defined by a single high pulse and a single low pulse, said device comprising:

variable duty pulse generating means for producing said fundamental frequency pulse signal and gradually decreasing a duty ratio of said pulse signal every predetermined period so as to provide an output signal having said gradually decreasing duty ratio; and means for applying said output signal produced by said variable duty pulse generating means to said buzzer.

2. The sound producing device of claim 1, wherein said duty ratio is decreased from 50% to 0% per said period.

3. The sound producing device of claim 1, further comprising means for amplifying said pulse signal.

* * * * *